US007261604B2

(12) United States Patent
Brake et al.

(10) Patent No.: US 7,261,604 B2
(45) Date of Patent: Aug. 28, 2007

(54) ELECTRICAL TERMINAL ELEMENT

(75) Inventors: Jens Brake, Wuppertal (DE); Eduard Cvasa, Bochum (DE); Bruce J. Serbin, Canfield, OH (US); John C Erste, Wilhelmsdorf (DE); John M. Chupak, West Middlesex, PA (US)

(73) Assignee: Delphi Technologies, Inc., Troy, MI (US)

( * ) Notice: Subject to any disclaimer, the term of this patent is extended or adjusted under 35 U.S.C. 154(b) by 20 days.

(21) Appl. No.: 10/741,590

(22) Filed: Dec. 22, 2003

(65) Prior Publication Data

US 2005/0136753 A1 Jun. 23, 2005

(51) Int. Cl.
*H01R 13/187* (2006.01)

(52) U.S. Cl. ..... 439/843; 439/877

(58) Field of Classification Search ..... 439/843, 439/274, 275, 587–589, 851–854, 856, 857, 439/877–882, 752; 174/73.1
See application file for complete search history.

(56) References Cited

U.S. PATENT DOCUMENTS 4,780,097 A * 10/1988 Piscitelli ..... 439/843
5,073,132 A * 12/1991 Nottrott ..... 439/884
5,299,949 A * 4/1994 Fortin ..... 439/275
5,516,310 A * 5/1996 Sawada ..... 439/843
5,989,078 A * 11/1999 Chaillot et al. ..... 439/851
6,186,840 B1 * 2/2001 Geltsch et al. ..... 439/843
6,565,396 B2 * 5/2003 Saka et al. ..... 439/843
6,672,910 B2 * 1/2004 Hotea ..... 439/843

FOREIGN PATENT DOCUMENTS

EP 0694991 1/1996
FR 1497952 10/1967

* cited by examiner

*Primary Examiner*—Gary F. Paumen
(74) *Attorney, Agent, or Firm*—David P. Wood

(57) ABSTRACT

The invention relates to an electrical terminal element for pushing through an opening, in particular a round opening, in an elastic material along a pushing through direction of the terminal element, comprising a contact part which has a connection section for the electrical and mechanical connection of the terminal element to an electrical lead, a dilating section and a contact section for the contacting of another terminal element arranged in series in the pushing through direction and comprising a reception part which at least partly surrounds the contact part in the region of the contact section and adjoins the dilating section. The invention also relates to a method for the manufacture of a terminal element in accordance with the invention.

18 Claims, 3 Drawing Sheets

ELECTRICAL TERMINAL ELEMENT

TECHNICAL FIELD

The invention relates to an electrical terminal element for pushing through an opening, in particular a round opening, in an elastic material along a pushing through direction of the terminal element as well as to a method for the manufacture of the same.

BACKGROUND OF THE INVENTION

Such terminal elements are generally known. The terminal elements are pushed through an opening in an elastic sealing material in order to seal an electrical joint position, with the opening cross-section of the sealing material being selected such that the sealing material tightly surrounds an electrical lead connected to the terminal element when the terminal element is pushed through. It is problematic with known terminal elements that the elastic material can tear easily when the terminal elements are pulled through the seal opening against the pushing through direction.

SUMMARY OF THE INVENTION

It is the underlying object of the invention to provide an electrical terminal element which does not damage the elastic material when it is pulled through the opening against the pushing through direction. A further object of the invention lies in providing a method for the manufacture of such a terminal element.

The first object is satisfied by an electrical terminal element, for pushing through an opening, in particular a round opening, in an elastic material along a pushing through direction of the terminal element, the terminal element comprising a contact part which has a connection section for the electrical and mechanical connection of the terminal element to an electrical lead, a dilating section and a contact section for the contacting of another terminal element arranged in series in the pushing through direction and further comprising a reception part which at least partly surrounds the contact part in the region of the contact section and adjoins the dilating section, with the cross-section of the contact part enlarging continuously in the pushing through direction in the dilating section.

Since the cross-section of the contact part enlarges continuously in the dilating section in the pushing through direction, the opening in the elastic material is continuously increasingly expanded when the terminal element is pulled through against the pushing through direction. There is no sudden displacement of the elastic material bounding the opening, but a displacement which gradually becomes larger, i.e. stress peaks in the material caused by discontinuous cross-section enlargements are avoided. This continuous, gradually increasing expansion of the opening makes it possible for the elastic material to match a larger cross-section of the terminal element on the pulling of the terminal element through the opening without tearing. Damage to the elastic material is avoided in this manner.

The pushing through direction is preferably oriented parallel to a longitudinal central axis of the terminal element. The expansion of the opening in the elastic material can take place either in one direction or in two directions, in particular two directions perpendicular to one another, transversely to the pushing through direction, e.g. in the direction of the width and of the height of the terminal element.

The reception part is made as a separate component and satisfies a protective function for the contact section of the contact part. In addition, it prevents an excessive expansion of the contact part on the insertion of a plug-in contact so that a reliable contact is also achieved after numerous plug-in procedures.

Furthermore, at least the contact part is preferably made as a stamped/bent part. At least the contact part can thereby be manufactured in a simple manner and with low economic and machine effort according to the stamping/bending method.

Advantageous embodiments of the invention can be seen from the dependent claims, from the description and from the drawing.

In accordance with an embodiment of the terminal element in accordance with the invention, the cross-section of the contact part enlarges in a first part section in a first direction transversely to the pushing through direction and in a second part section following the first part section in the pushing through direction in a second direction differing from the first direction transversely to the pushing through direction. The two directions preferably define a width and a height of the terminal element. By the expansion of the opening in two steps, the elastic material is displaced in a particularly gentle manner and damage to the material can be avoided even more effectively. Due to a low number of required bending procedures, this embodiment moreover allows a simple, and thus cost-favorable, manufacture of the terminal element.

The contact part can widen in the dilating section in one direction at least approximately up to a width of the reception part in this direction. In this context, an at least approximate enlargement of the contact part means that the contact part enlarges at least so much that there are substantially no edges in the transition region from the dilating section to the reception part which could result in damage to the elastic material. Assuming that the height of the reception part is not substantially larger than that of the contact part, the cross-section of the terminal element in the dilating section can consequently enlarge, starting from a cross-section of the contact part in the connection section, up to the cross-section of the reception part. The opening in the elastic material is thus continuously expanded by the dilating section up to the cross-section size of the receiving part, whereby damage to the elastic material is prevented even more effectively.

In accordance with a further embodiment, the contact part has at least one wall in the dilating section, preferably an upper wall and a lower wall, with a curved lateral outer boundary. The wall increases the stability of the terminal element and does not necessarily have to be made in one piece, but can also be in two pieces i.e. be composed of two wall halves. The stability of the terminal element is increased by the use of an upper wall and a lower wall. Each wall preferably has two curved outer boundaries which each lie on opposite sides of a longitudinal axis of the terminal element. The outer boundary/boundaries advantageously has/have a convex curvature. A particularly effective and gentle displacement of the elastic material is hereby achieved.

The curvature of the lateral outer boundary can decrease in the pushing through direction. In this manner, the opening in the elastic material is initially, i.e. on the transition from the connection section to the dilating section, expanded more on the pulling through of the terminal element against the pushing through direction than at the end, i.e. close to the transition from the dilating section to the reception part. This course of the expansion of the opening contributes to avoiding a tearing of the elastic material even more effectively.

The angle which a tangent applied to the curved outer boundary forms with the pushing through direction preferably lies in the range from approximately 20° to 60° in a rear region (considered in the pushing through direction) of the outer boundary and lies in the range from approximately 0° to 20° in a front region of the outer boundary. A particularly gentle expansion of the opening is achieved at these angles.

The lateral outer boundary can extend at least approximately tangentially to an outer side of the reception part in the region of the reception part. In this manner, the transition from the dilating section to the reception part is substantially free of edges, whereby damage to the elastic material is prevented even more effectively.

The upper wall and the lower wall preferably bound an opening of the contact part, in particular an opening for a second latching connection of the terminal element. In this manner, the dilating section satisfies a dual function: on the one hand, it expands the opening in the elastic material on the pulling out of the terminal element; and, on the other hand, it encompasses an opening which can be used e.g. for a second latching connection.

The contact section of the contact part can have contact spring arms for the contacting of a plug-in contact. The contact spring arms allow a reliable contacting of a plug-in contact. The reception part can be provided with spring arms via which the reception part interacts with the contact spring arms of the contact part.

In accordance with yet a further embodiment of the terminal element in accordance with the invention, the contact part is made of a first material and the reception part is made of a second material, with the first material having a higher electrical conductivity than the second material and the second material having better elasticity properties than the first material. The contact part and the reception part can be optimized for their respective purposes separately from one another by the use of different materials. A material can be selected for the contact part which has a particularly high electrical conductivity, for example a copper sheet. In contrast, a reception part provided with spring arms can, for example, be formed from a material which has particularly good spring properties which in particular have long term stability, e.g. a steel sheet. The terminal element in this manner ensures a particularly low-loss electrical contact of another terminal element and simultaneously allows a permanently reliable mechanical contact of the other terminal element.

The reception part can furthermore have at least one latch opening which allows a latching of the terminal element in a housing.

To satisfy the second object, a method is provided for the manufacture of an electrical terminal element, in particular of an electrical terminal element in accordance with any one of the types described above, in which a contact part having a contact section, a connection section and a dilating section disposed therebetween is stamped out of a metal sheet such that the dilating section has at least one opening with a concave lateral boundary which, together with a bending line of the contact part, bounds a sheet metal tongue, a reception part is stamped out of a metal sheet, the contact part and the reception part are bent over along the bending line and, optionally, along further pre-determined bending lines, and the parts are joined together such that the reception part at least partly surrounds the contact part in the region of the contact section.

Using the method, a terminal element in accordance with the invention can be manufactured in a simple manner and with low economic and machine effort in accordance with the stamping/bending method. A wall with a convex, preferably convexly curved, lateral outer boundary is formed after the bending over of the contact part by the stamping out of the opening with a concave lateral boundary. The bending lines used correspondingly on the bending over of the contact part extend substantially parallel to the pushing through direction.

Two openings are preferably stamped out which each have two oppositely disposed concave boundaries such that, after bending over the contact part, an upper wall and a lower wall are formed with respectively convexly curved outer boundaries in the dilating section, by which an opening bounded by an elastic material can be expanded on the pulling of the terminal element through the opening.

BRIEF DESCRIPTION OF THE DRAWINGS

The invention will be described in the following purely by way of example with reference to an advantageous embodiment and to the enclosed drawings. There are shown.

DESCRIPTION OF THE PREFERRED EMBODIMENTS

Figure 2:
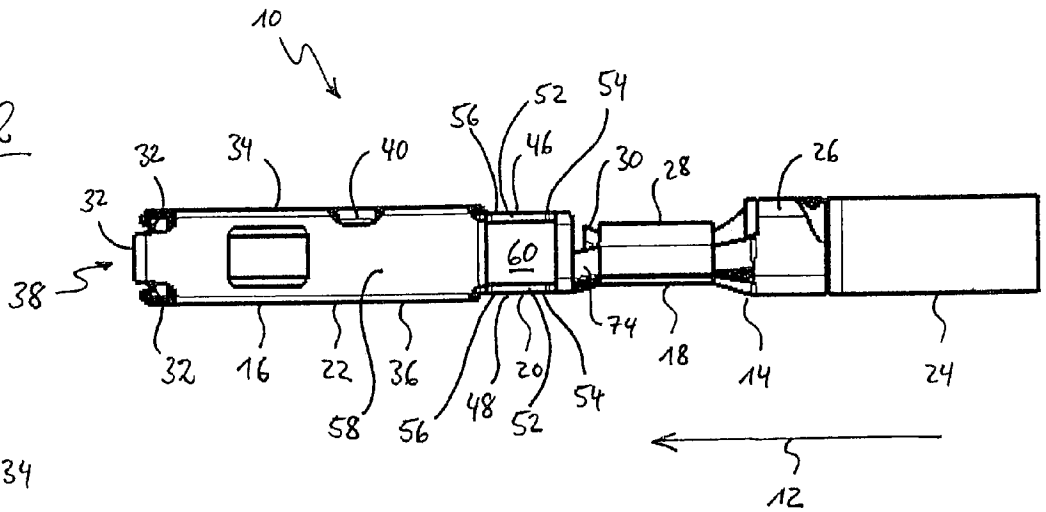
FIG. 2 is a side view of the terminal element of FIG. 1.
Figure 1:
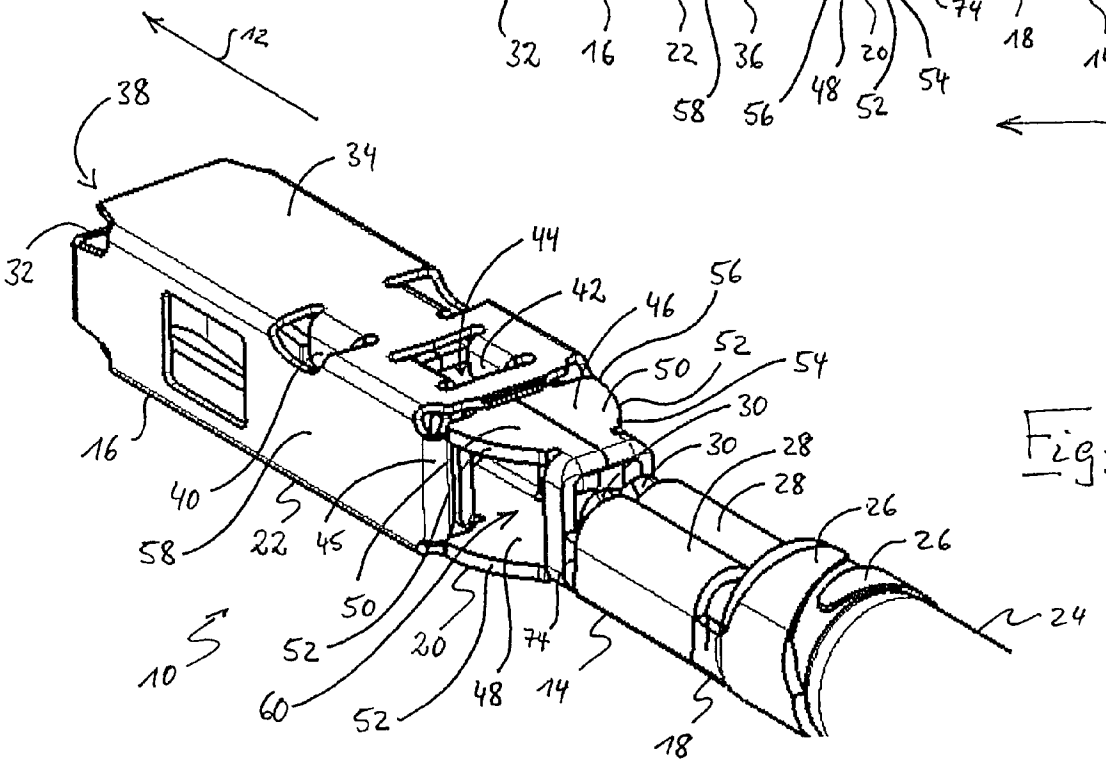
FIG. 1 is a perspective view of an embodiment of an electrical terminal element in accordance with the invention.
Figure 3:
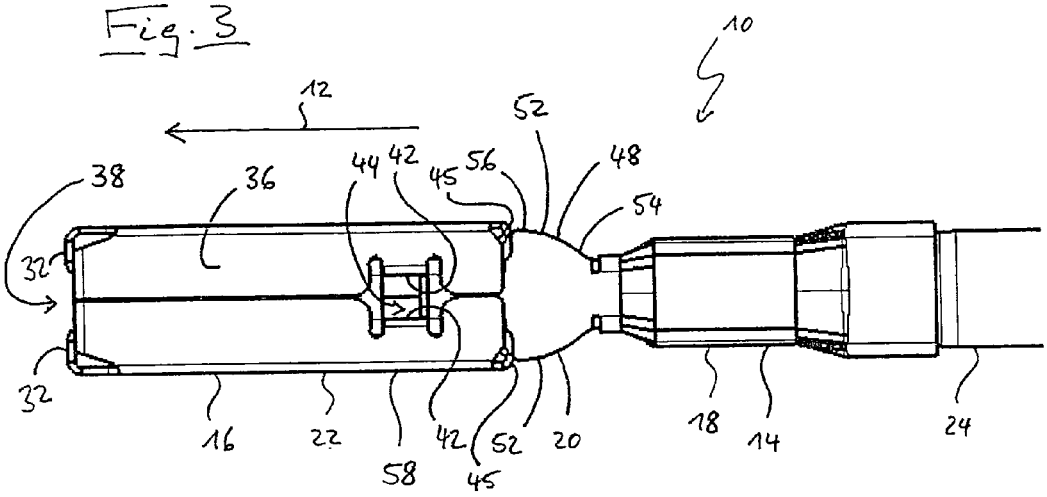
FIG. 3 is a plan view of a lower side of the terminal element of FIG. 1.

FIGS. 1 to 3 show a terminal element 10 to be pushed through an opening in an elastic material (not shown) along a pushing through direction 12 of the terminal element 10. The pushing through direction 12 is oriented substantially parallel to a longitudinal central axis of the terminal element 10.

The terminal element 10 includes a contact part 14 and a mounted reception part 16. The contact part 14 has a connection section 18, a dilating section 20 and a contact section 22 arranged in series in the pushing through direction 12.

The connection section 18 serves for the electrical and mechanical connection of the terminal element 10 to an electrical lead 24. For this purpose, in the connection section 18, the contact part 14 has both tongues 26, by which the electrical lead 24 can be fixed to the connection section 18, and tongues 28, by which stripped electrical conductors 30 of the electrical lead 24 can be contacted mechanically and electrically. The tongues 26, 28 are brought into the condition shown in FIGS. 1 and 2 by being bent over.

The contact section 22 of the contact part 14 is made as a socket section in the embodiment shown and forms a reception space for the reception of a plug-in contact (not shown).

However, in accordance with the invention, it is also possible to make the contact section 22 as a plug-in contact.

The reception part 16 has a right parallelepiped shaped basic shape and surrounds the contact part 14 in the region of the contact section 22. The reception part 16 is admittedly also frequently called a spring cover, but it does not have to have any spring properties.

The reception part 16 has tongues 32 which project from the walls of the reception part 16 and are bent over into the reception part 14 in the region of the insertion opening 38 for the plug-in contact in order to form a guide for the plug-in contact which facilitates the insertion of the plug-in contact into the contact part 14 and prevents damage to contact arms of the contact section 22 on an improper insertion of a plug-in contact.

To assist a mechanical contact of a plug-in contact inserted into the contact section 22 of the contact part 14 formed as a socket section or to prevent an excessive expansion of the contact section 22 by an inserted plug-in contact, two support tabs 40 are formed at an upper wall 34 of the reception part 16 which have been bent over into the reception room for the plug-in contact and which limit a deflection of a contact arm of the contact section 22 on the insertion of a plug-in contact into the contact section 22.

In a rear region (considered in the pushing through direction 12) of the upper and lower walls 34, 36 of the reception part 16, two securing tabs 42 are moreover provided in each case which have been bent over into the reception space of the contact section 22 and engage into corresponding securing openings 44 of the contact part 14. The reception part 16 is secured to the contact part 14 by the securing tabs 42 engaging into the securing openings 44 such that the reception part 16 cannot accidentally be pulled off from the contact part 14.

Furthermore, a latch opening 43 is provided in each side wall 58 of the reception part 16 and facilitates a latching of the terminal element 10 in a housing.

As can be recognized in FIGS. 1 and 3, the reception part 16 has a larger cross-section than the contact part 14. The width of the reception part 16 is in particular larger than the width of the contact part 14 in the connection section 18. The width of the contact part 14 enlarges approximately up to the width of the reception part 16 in the dilating section 20 disposed between the connection section 18 and the contact section 22.

The reception part 16 has tongues 45 at its end facing toward the dilating section 20 which project from side walls 58 of the reception part 16 and have been bent over into the reception part 16. The tongues 45 serving as guides for the opening boundary contribute to avoiding damage to the elastic material on the pulling of the terminal element through the openings.

The dilating section 20 is formed by an upper wall 46 and a lower wall 48 of the contact part 14, with the upper wall 46 being composed of two wall halves 50 due to the design of the contact part 14 as a stamped/bent part.

The walls 46, 48 each have two lateral, oppositely disposed, convexly curved outer boundaries 52, with the curvature of the lateral outer boundaries 52 decreasing in each case in the pushing through direction 12 (cf. FIG. 3). The maximum spacing which is present between the lateral outer boundaries 52 of a wall 46, 48 defines in this context the width of the contact part 14 in the dilating section 20.

The angle which a tangent applied to the curved lateral outer boundary 52 forms with the pushing through direction 12 amounts in a rear region 54 (considered in the pushing through direction 12) of the lateral outer boundary 52 to approximately 33° and in a front region 56 of the lateral outer boundary 52 to approximately 0°, i.e. the lateral outer boundaries 52 extend substantially tangentially to outer sides 58 of the reception part 16 in the region 56 of the reception part 16.

In the embodiment shown, the upper and lower walls 46, 48 are oriented parallel to one another and bound an opening 60 of the contact part 14, in the embodiment shown a transverse passage for a second latching connection of the terminal element 10.

Generally, in another embodiment, the upper and lower walls 46, 48 can, however, also be tilted with respect to one another and run apart, for example, in the pushing through direction 12. In this case, the walls 46, 48 additionally result, in addition to an expansion of the opening by the convex lateral outer boundaries 52, in an expansion of the opening in a second direction.

In the embodiment shown, the walls 46, 48 of the dilating section 20 are made symmetrically with respect to a longitudinal central axis of the terminal element 10, i.e. the lateral outer boundaries 52 of each wall 46, 48 each have the same extents of curvature. Furthermore, the upper and lower walls 46, 48 both have lateral outer boundaries 52 of the same curvature, i.e. the walls 46, 48 substantially have a congruent contour.

In accordance with the invention, however, it is also conceivable for at least one of the walls 46, 48 to be made asymmetrically, i.e. to have lateral outer boundaries 52 of different curvatures, and/or for the upper wall 46 and the lower wall 48 each to have different outer contours.

Figure 4:
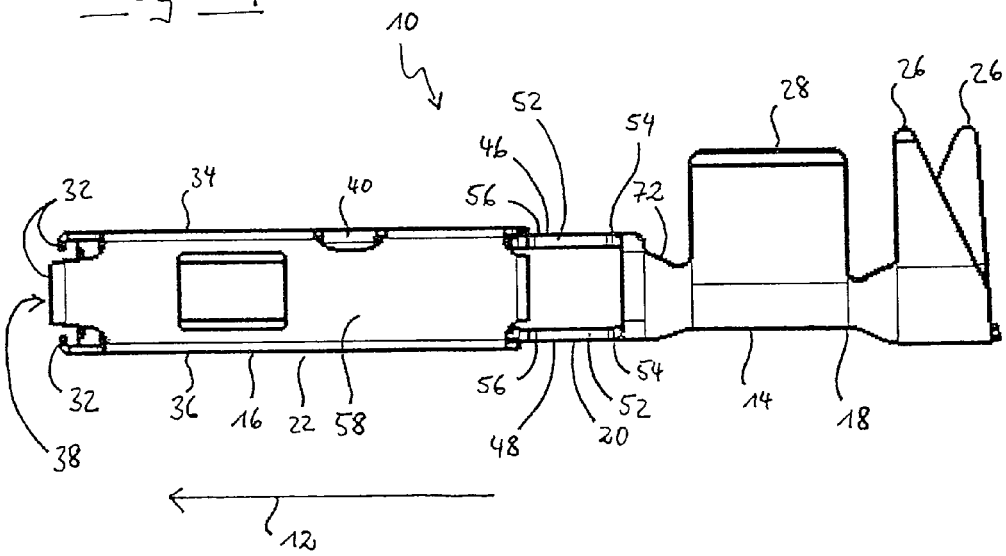
FIG. 4 is a side view of a further embodiment of a terminal element in accordance with the invention.

FIG. 4 shows a further embodiment of a terminal element 10 in accordance with the invention. The tongues 26, 28 for the mechanical and electrical connection of the terminal element 10 to an electrical lead have not yet been bent over in this embodiment.

In contrast to the embodiment described in connection with FIGS. 1 to 3, the contact part 14 of the terminal element 10 shown in FIG. 4 additionally has two lateral ramps 72 in its dilating section 20 which extend substantially orthogonally to the walls 46, 48 and which are arranged, considered in the pushing through direction 12, behind the opening 60 or behind the walls 46, 48, i.e. between the walls 46, 48 and the connection section 18. On the one hand, the stability of the contact part 14 is increased by the ramps 72 and, on the other hand, the height of the dilating section 20 increases in the pushing through direction 12. The ramps 72 merge into the upper and lower walls 46, 48.

The dilating section 20 therefore has two part sections which follow one another in the pushing through direction 12, namely, on the one hand, a part section formed by the ramps 72 and, on the other hand, a part section formed by the walls 46, 48. The expansion therefore takes place in two phases on the pulling of the terminal element 10 through an opening: the elastic material bounding the opening is first displaced in a first direction transversely to the pushing through direction 12 by the ramps 72, namely in the direction of the height of the terminal element 10, i.e. the opening is expanded to the spacing of the walls 46, 48. Subsequently, the material is additionally displaced by the convex lateral outer boundaries 52 of the walls 46, 48 in a second direction transversely to the pushing through direction 12 and the opening is expanded to the width of the reception part 16. This expansion procedure in two steps has proved to be particularly gentle for the elastic material.

A terminal element 10 in accordance with the invention is manufactured by stamping out the contact part 14 and the reception part 16 from corresponding metal sheets, by bending over the respective sheet metal parts and by a subsequent joining together of the contact part 14 and the reception part 16.

Figure 5:
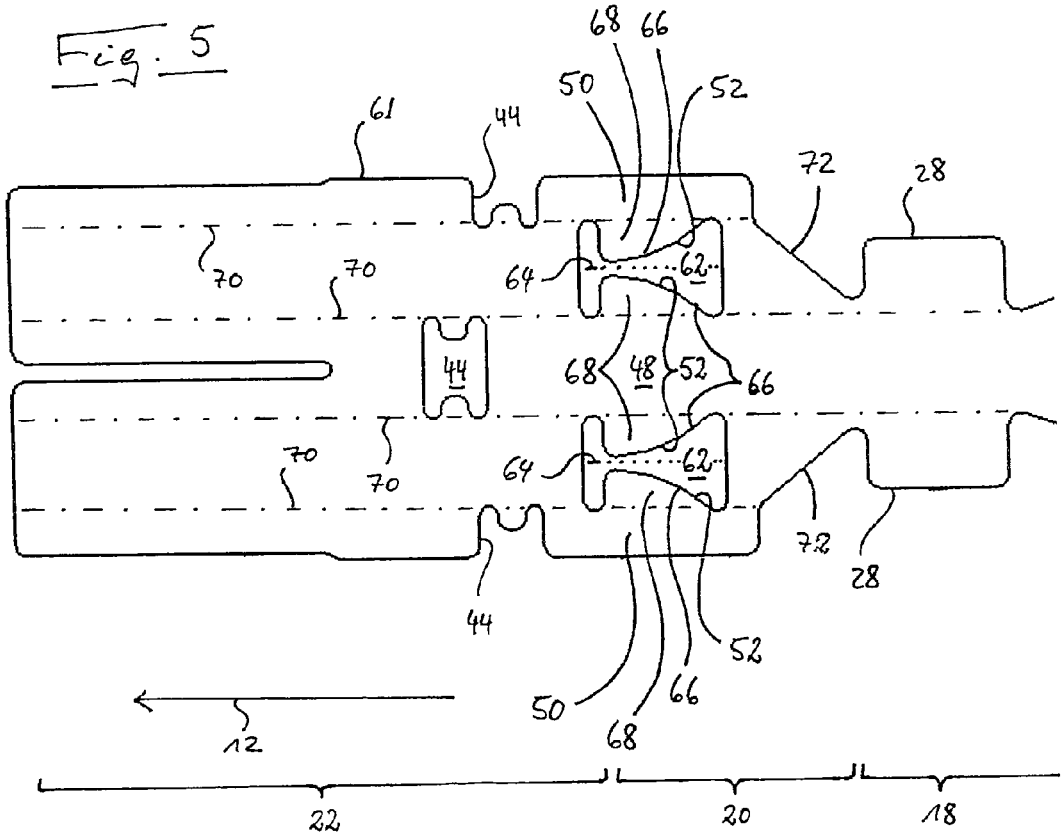
FIG. 5 is a plan view of a stamped out metal sheet from which a contact part is formed for the terminal element of FIG. 4.

FIG. 5 shows a stamped out sheet metal part 61 of a contact part 14 for the terminal element of FIG. 4. The contact part 14 is in the planar state i.e. it has not yet been bent over. The contact section 22, the dilating section 20 and a subsequent part of the connection section 18 can be recognized.

To achieve the fact that the width of the dilating section 20 enlarges at least approximately up to the width of the reception part 16 in the bent over state of the contact part 14, i.e. in order to manufacture the upper and lower walls 46, 48 of the dilating section 20, two openings 62 have been stamped out of the contact part 14.

The openings 62 each have a substantially rectangular basic shape and are each made in specular symmetry with respect to a symmetry axis 64 which extends parallel to a longitudinal central axis or pushing through direction 12 of the contact part 14. The openings 62 furthermore each have a concave boundary 66 at both sides of the symmetry axis 64, i.e. at both sides of the symmetry axis 64, sheet metal tongues 68 with convex outer boundaries project into the openings 62. The sheet metal tongues 68 are each bounded by the concave boundary 66 of the respective opening 62 and by a bending line 70 of the contact part 14.

In total, four bending lines 70 are provided which each extend parallel to the pushing through direction 12 or to the longitudinal central axis of the contact part 14. The bending lines 70 each extend tangentially to the openings 62.

The sheet metal tongues 68 are not also bent over on the bending over of the contact part 14 along the bending lines 70. The region of the sheet metal part 61 disposed between the two openings 62 in this manner forms the lower wall 48 in the bent over state of the contact part 14, whereas the regions of the sheet metal part 61, which are located at the sides of the openings 62 facing away from one another, each form the wall halves 50 of the upper wall 46 of the contact part 14. The curved boundaries of the sheet metal tongues 68 consequently simultaneously form the lateral outer boundaries 52 of the upper and lower walls 46, 48 of the dilating section 20 in the bent over state of the contact part 14.

Two ramps 62 extend obliquely to the longitudinal central axis of the contact part 14 from the inner to the outer bending line 70 in each case such that the dilating section 20 of the sheet metal part 61 widens in the pushing through direction 12, starting from the connection section 18, in the planar state. The ramps 72 are bent over approximately at right angles to the plane of the planar sheet metal part 62 along the inner bending lines 70 on the bending over of the contact part 14.

The difference between the sheet metal part 61 of the second embodiment shown in FIG. 5 and the correspondingly stamped out sheet metal part of the first embodiment shown in FIGS. 1 to 3 lies in the fact that the sheet metal part of the first embodiment has, instead of the ramps, side wall sections 74 which have an approximately parallelogram or rectangular shape and which have a lower height in the bent over state than the dilating section 20 and the tongues 28 of the connection section.

In the embodiments shown, the terminal element 10 is in each case made as a stamped/bent part. The contact part 14 and the reception part 16 have different materials. The contact part 14 is thus made of a material having a particularly high electrical conductivity, for example of a copper sheet, whereas the reception part 16 has a material with particularly good spring properties, which have long term stability and is made, for example, of a steel sheet. In this manner, the terminal element 10 simultaneously has particularly good electrical and mechanical contact properties.

Generally, it is also possible in accordance with the invention to produce the contact part 14 and the reception part 16 of the same material. In accordance with the invention, the terminal element 10 does not necessarily have to be made as a stamped/bent part, but can equally be manufactured in another manner, for example by soldering or bonding.

What is claimed is:

1. An electrical terminal element for pushing through an opening, in particular a round opening, in an elastic material along a pushing through direction of the terminal element, comprising a contact part which has a connection section for the electrical and mechanical connection of the terminal element to an electrical lead, a dilating section and a contact section for the contacting of another terminal element, arranged in series in the pushing through direction, and further comprising a reception part which at least partly surrounds the contact part in the region of the contact section and adjoins the dilating section, with the cross-section of the contact part enlarging continuously in the pushing trough direction in the dilating section wherein the contact part has at least one wall with a curved lateral outer boundary in the dilating section, and the curvature of the lateral outer boundary decreases in the pushing through direction.

2. The terminal element of claim 1, wherein the cross-section of the contact part in the dilating section enlarges in a first part section in a first direction and in a second part section in a second direction;

wherein said first direction and said second direction are transverse to said pushing through direction, wherein said second direction deviates from said first direction; and wherein said second part section follows said first part section in the pushing through direction.

3. The terminal element of claim 1, wherein the contact part widens in the dilating section at least approximately up to a width of the reception part.

4. The terminal element of claim 1, wherein the contact part has at least an upper wall and a lower wall.

5. The terminal element of claim 4, wherein the lateral outer boundary extends at least approximately tangentially to an outer side of the reception part in the region of the reception part.

6. The terminal element of claim 4, wherein the upper wall and the lower wall bound an opening of the contact part, in particular for a second latching connection of the terminal element.

7. The terminal element of claim 1, wherein the contact section of the contact part has contact spring arms for the contacting of a plug-in contact.

8. The terminal element of claim 1, wherein the contact part is made of a first material and the reception part is made of a second material, with the first material having a higher electrical conductivity than the second material and the second material having better elasticity properties than the first material.

9. An electrical terminal element for pushing through an opening, in particular a round opening, in an elastic material along a pushing through direction of the terminal element, comprising a contact part which has a connection section for the electrical and mechanical connection of the terminal element to an electrical lead, a dilating section and a contact section for the contacting of another terminal element, arranged in series in the pushing through direction, and further comprising a reception part which at least partly surrounds the contact part in the region of the contact section and adjoins to dilating section, with the cross-section of the contact part enlarging continuously in the pushing through direction in the dilating section;

wherein the contact part has at least one wall, preferably an upper wall and a lower wall, with a curved lateral outer boundary in the dilating section; and wherein the curvature of the lateral outer boundary decreases in the pushing through direction.

10. An electrical terminal element for pushing through an opening, in particular a round opening, in an elastic material along a pushing through direction of the terminal element, comprising a contact part which has a connection section for the electrical and mechanical connection of the terminal element to an electrical lead, a dilating section and a contact section for the contacting of another terminal element, arranged in series in the pushing through direction, and further comprising a reception part which at least partly surrounds the contact part in the region of the contact section and adjoins the dilating section, with the cross-section of the contact part enlarging continuously in the pushing through direction in the dilating section;

wherein the contact part has at least one wall, preferably an upper wall and a lower wall, with a curved lateral outer boundary in the dilating section; and wherein the angle which a tangent applied to the curved lateral outer boundary forms with the pushing through direction lies in the range from approximately 20° to 60° in a rear region of the outer boundary and lies in the range from approximately 0° to 20° in a front region of the outer boundary.

11. An electrical terminal element for pushing through an opening, in particular a round opening, in an elastic material along a pushing through direction of the terminal element, comprising a contact part which has a connection section for the electrical and mechanical connection of the terminal element to an electrical lead, a dilating section and a contact section for the contacting of another terminal element, arranged in series in the pushing through direction, and further comprising a reception part which at least partly surrounds the contact part in the region of the contact section and adjoins the dilating section, with the cross-section of the contact part enlarging continuously in the pushing through direction in the dilating section wherein the contact part has at least one wall with a curved lateral outer boundary in the dilating section; and wherein the angle which a tangent applied to the curved lateral outer boundary forms with the pushing through direction lies in the range from approximately 20° to 60° in a rear region of the outer boundary and lies in the range from approximately 0° to 20° in a front region of the outer boundary.

12. The terminal element of claim 11, wherein the cross-section of the contact part in the dilating section enlarges in a first part section in a first direction and in a second part section in a second direction;

wherein said first direction and said second direction are transverse to said pushing through direction;

wherein said second direction deviates from said first direction; and wherein said second part section follows said first part section in the pushing through direction.

13. The terminal element of claim 11, wherein the contact part widens in the dilating section at least approximately up to a width of the reception part.

14. The terminal element of claim 11, wherein the contact part has at least an upper wall and a lower wall.

15. The terminal element of claim 14, wherein the lateral outer boundary extends at least approximately tangentially to an outer side of the reception part in the region of the reception part.

16. The terminal element of claim 14, wherein the upper wall and the lower wall bound an opening of the contact part, in particular for a second latching connection of the terminal element.

17. The terminal element of claim 11, wherein the contact section of the contact part has contact spring arms for the contacting of a plug-in contact.

18. The terminal element of claim 11, wherein the contact part is made of a first material and the reception part is made of a second material, with the first material having a higher electrical conductivity than the second material and the second material having better elasticity properties than the first material.

* * * * *